United States Patent [19]

Hall

[11] 4,063,727

[45] Dec. 20, 1977

[54] ARM WRESTLING EXERCISE DEVICE

[76] Inventor: James A. Hall, 40 Town Hill Ave., Danbury, Conn. 06810

[21] Appl. No.: 706,221

[22] Filed: July 19, 1976

[51] Int. Cl.[2] ..... A63B 21/04

[52] U.S. Cl. ..... 272/136; 272/67

[58] Field of Search ..... 272/67, 68, 76, 136, 272/137, 143, 140, 138, 134, 135, 130, 110, 95, 96, 116, 93, DIG. 5; 2/159; 128/25 R, 26; 73/279, 280; 273/55 R

[56] References Cited

U.S. PATENT DOCUMENTS

| | | | |
|---|---|---|---|
| 3,428,311 | 2/1969 | Mitchell | 272/67 |
| 3,467,376 | 9/1969 | Feinberg | 272/67 |
| 3,486,750 | 12/1969 | Krawitz | 272/63 |
| 3,567,219 | 5/1969 | Foster | 272/135 |
| 3,662,602 | 5/1972 | Weiss | 272/DIG. 5 |
| 3,680,861 | 8/1972 | Schmidt | 273/55 R |
| 3,788,297 | 1/1974 | Borst | 124/7 |
| 3,804,410 | 4/1974 | Gilman | 273/55 R |
| 3,947,025 | 3/1976 | Hobby | 272/135 |

*Primary Examiner*—William H. Grieb
*Assistant Examiner*—William R. Browne

[57] ABSTRACT

An arm wrestling exercise device includes a base member clampable to a support surface, an elongated resilient arm secured pivotably at one end thereof to the base and a hand grip member secured to the other end of the arm. The arm has at least one flexible spring rod embedded therein and the hand grip member has a plurality of finger elements each of which has an internal flexible spring element. The hand grip member is positionable on the arm at selected distances from the base.

5 Claims, 2 Drawing Figures

ARM WRESTLING EXERCISE DEVICE

BACKGROUND OF THE INVENTION

The present invention relates to arm wrestling exercise devices.

Arm and hand wrestling devices have been known heretofore. Their value as amusement devices and for developing and strengthening hand, wrist and arm muscles has also been appreciated. Weiss apparatus a horizontal pivot rod is mounted in the base and an elongate rigid assembly including a gripping portion and a pair of parallel limbs are pivotably mounted on the pivot rod. A plurality of external springs are connected to the elongate assembly such that manipulation thereof against the bias of the springs results in the desired exercise. The prior art does not afford resiliency and consequent biasing forces in the same manner as in actual hand wrestling. There is need, therefore, for an arm wrestling device which more closely simulates actual arm wrestling, which permits length adjustment to accommodate different are lengths, and which is of relatively simple construction.

SUMMARY OF THE INVENTION

It is one object of the invention to provide an arm wrestling exercise device which resembles the arm and hand of an opponent and simulates the actual development of resistive forces through a unique spring arrangement.

Another object of the invention is to provide an arm wrestling exercise device of the character described which is simple in construction and can be easily assembled and disassembled.

Other objects and advantages of the invention will become readily apparent from the following description of the invention.

According to the present invention there is provided an arm wrestling exercise device comprising: a rigid base member; an elongated pivot arm secured detachably and pivotably at one end thereof to the base member and normally extending perpendicularly therefrom, the arm being formed of a resilient material and having spring tensioning means embedded therein; a hand grip member having a plurality of resilient finger elements detachably secured to the free end of said arm to be pivotable therewith; and means on said arm and hand grip member cooperable to permit securing of the hand grip member to the arm at any of a plurality of distances relative to the base.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
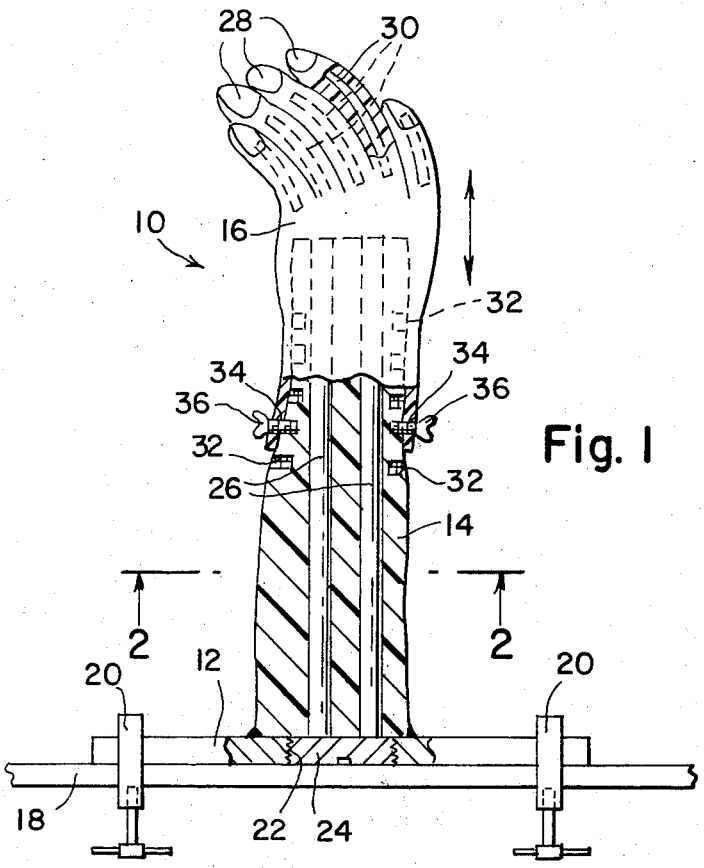
FIG. 1 is an elevational view, partly broken away and partly In cross-seciton, of an arm wrestling exercise device embodying the features of the invention.
Figure 2:
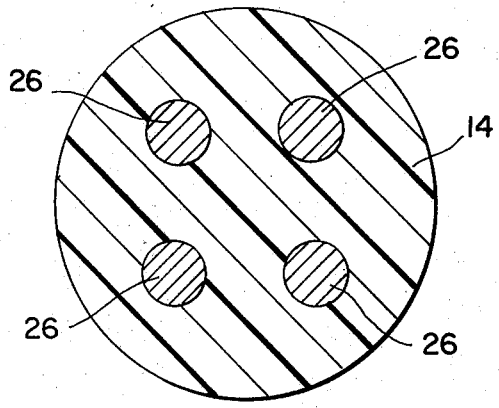
FIG. 2 is a cross-sectional view of the arm of the device shown in FIG. 1 taken along line 2—2 thereof.

Referring to the drawings there is shown an arm wrestling exercise device 10. The device comprises a rigid base member 12 to which one end of an elongated arm 14 is detachably secured and which in turn is surmounted by a hand grip member 16.

The base member is rigid and, as shown in FIG. 1, is intended to be clamped in place on an external support surface 18, such as a table, by means such as C-clamps 20. The base member is desirably provided with a central aperture 22 which is threaded to receive a plug element 24 therein and thereby detachably secure the arm 14 to the base.

The elongated arm 14 is preferably made of a resilient or elastomeric material such as rubber or the like. At its lower end the arm may be given a plug element 24. Desirably the plug element is formed integrally with the arm such as during a molding process. However, it is also within the comtemplation to secure the plug element to one or more rod-like spring members 26 which are themselves embedded within the arm and may be integrated in the arm as during a molding procedure. Four of such spring rods extending longitudinally within the arm, as shown in FIG. 12, is preferred. It will be understood that by the construction of the base and arm described the arm is privotably secured to the base member and may be universally deflected about its lower end. The spring rods serve to provide predetermined resistance against pivotal movement, particularly when connected with the plug element which is fixedly secured within the aperture in the base member. The spring force, however, returns the arm to a normal position perpendicular to the base.

Surmounting the free end of the arm 14 is hand grip member 16. The hand grip member is formed of a resilient or elastomeric material similar to that of the arm and includes a plurality of finger elements 28 each of which is provided with an internal flexible spring element 30 which permits limited pivotal movement of the finger element. Desirably the hand grip member is provided with five finger elements so that it resembles in appearance and in resistive force development an actual hand. Such finger elements are thus seen as presenting a set of resilient or spring members independent of the resiliency of the arm 14 and offering finger-resisting forces which complement the forces developed in the arm 14. Such combination of spring forces imparts to the device an exercise capability which is unique.

The arm 14 is provided with a plurality of pairs of threaded bores 32 located at different distances from the lower end of the arm. The bores of each pair are formed at opposed diametral locations of the arm. The hand grip member is provided with a pair of apertures 34 which are alignable with a selected pair of bores in the arm. Such apertures and bores are dimensioned to permit the insertion of threaded fastening means such as screws 36 so as to enable the positioning of the hand grip member at a selected distance from the base. This affords convenience in adapting the device for use by persons of different ages and with different arm lengths.

From the foregoing it will be seen that an arm wrestling exercise device has been provided which is adjustable for persons of different physical size and which simulates actual arm wrestling both in visual appearance and in tensioned reaction.

I claim:

1. An arm wrestling exercise device comprising:

a rigid base member; an elongated pivot arm secured detachably and non-movably at one end thereof to said base member normally extending perpendicularly therefrom, said arm being formed of a resilient material and having spring tensioning means embedded therein for providing predetermined resistance to the pivotal movement of said arm about the said one end thereof;

a hand grip member having a plurality of resilient finger elements detachably secured to the free end of said arm to be pivotable therewith, each of said finger elements being provided with an internally positioned spring element for providing predetermined resistance to the pivotal movement of such fingers;

and means on said arm and hand grip member cooperable to permit securing of said hand grip member to said arm at any of a plurality of distances relative to said base.

2. An arm wrestling exercise device according to claim 1 wherein said arm is provided with a plurality of pairs of threaded bores spaced longitudinally along same the bores of each pair being formed at opposed diametral locations of the arm, said hand grip member being provided with a pair of apertures alignable with any selected pair of bores in said arm and dimensioned to receive threaded fastening means insertable therethrough and cooperable with the aligned threaded bore in the arm to thereby secure said arm and hand grip member releasably.

3. An arm wrestling exercise device according to claim 1, wherein said spring tensioning means in said arm comprises at least one flexible spring rod extending longitudinally thereof.

4. An arm wrestling exercise device according to claim 1, wherein said base includes a central threaded aperture therein and said one end of said arm is provided with a plug element having external threads thereon cooperable with the threads in said base aperture, whereby said arm can be detachably secured to said base.

5. An arm wrestling exercise device according to claim 1, including clamping means for securing said base to an external support surface.

* * * * *